US006377146B1

(12) United States Patent
Batteux

(10) Patent No.: US 6,377,146 B1
(45) Date of Patent: Apr. 23, 2002

(54) BALL ACTUATOR

(75) Inventor: Pierre Batteux, St Pierre de Mesage (FR)

(73) Assignee: Schneider Electric Industries SA (FR)

( * ) Notice: Subject to any disclaimer, the term of this patent is extended or adjusted under 35 U.S.C. 154(b) by 0 days.

(21) Appl. No.: 09/967,974

(22) Filed: Oct. 2, 2001

(30) Foreign Application Priority Data

Oct. 27, 2000 (FR) ..... 2000 13789

(51) Int. Cl.[7] ..... H01F 3/00; H01F 3/08; H01F 7/08

(52) U.S. Cl. ..... 335/280; 335/253; 335/261; 335/279

(58) Field of Search ..... 335/253, 255, 335/259, 261–264, 279, 280

(56) References Cited

U.S. PATENT DOCUMENTS 3,665,813 A * 5/1972 Loveless ..... 92/30
4,309,022 A * 1/1982 Reinicke et al. ..... 251/297
5,022,690 A * 6/1991 Coltrin et al. ..... 292/21
5,445,546 A * 8/1995 Nakamura ..... 192/21

FOREIGN PATENT DOCUMENTS

| | | |
|---|---|---|
| DE | 1 006 044 | 4/1957 |
| DE | 1 131 304 | 6/1962 |
| DE | 23 40 450 | 3/1975 |
| FR | 1 060 856 | 4/1954 |
| FR | 2 417 177 | 9/1979 |

* cited by examiner

*Primary Examiner*—Ramon M. Barrera
(74) *Attorney, Agent, or Firm*—Parkhurst & Wendel, L.L.P.

(57) ABSTRACT

A ball actuator 10 comprises a case 12 supporting a striker 14 with an energy storage spring 16, a control rod 18 movable in translation in a direction parallel to a geometric axis 19, detent balls 20 and control balls 22. When the rod is moved in translation by an electromagnetic relay 100, the control balls 22 escape and enable the detent balls 20 to be freed so that the striker 14 is released. Each control ball 22 is in contact with two detent balls 20 and with the rod 18 so that the forces applied to the rod 18 by the control balls 20 are much lower than the forces exerted by the striker 14 on the detent balls 22. A high-efficiency actuator is thus achieved requiring a low operating energy and with small overall dimensions.

16 Claims, 6 Drawing Sheets

BALL ACTUATOR

BACKGROUND OF THE INVENTION

The invention relates to a ball actuator of great efficiency and with small dimensions, designed in particular for commanding an opening and closing mechanism of an electrical switchgear apparatus, in particular for command of a power circuit breaker.

STATE OF THE ART

The document DE 2,340,450 describes a latching device with detent balls for latching an electrical switch, comprising a latching bolt sliding in translation in a case and a control sub-assembly formed by a control rod with axial movement arranged perpendicularly to the axis of translation of the bolt and equipped with a support plate for two balls. In the latched position, a first of the two balls bears on one side on a flat end of the bolt and on the other side on the rod. The surface of the flat end of the bolt is parallel to the contact surface of the rod so that the bolt only transmits purely radial forces to the rod. These forces are taken up by the second ball located between the rod and the case. The end of the bolt further comprises in a bottom part a chamfer forming a ramp. To release the bolt, the rod simply has to be moved, so that the first ball rolls into contact with the rod on the one hand and with the flat end of the bolt on the other hand, until it is facing the ramp of the bolt. At this moment, the ball is ejected and releases the bolt. Such a device has a relatively good performance, but it is extremely sensitive to dimensional tolerances and to wear of the parts. The forces applied to the rod by the two balls are great and can leave an imprint in the rod. Moreover, if the diameter of the second ball does not correspond exactly to the distance between the rod and the case, the radial forces transmitted to the rod by the first ball in the latched position will not be fully transmitted to the second ball and will tend to deform the rod.

The document DE 1,131,304 describes a latching device of a catch of a high-voltage electrical switch, comprising a latching bolt sliding in a case and bearing on a row of four rollers. In the latched position, the four rollers are aligned in the axis of translation of the bolt, and the roller the farthest away from the bolt bears on a wall of the case. A push-button enables the intermediate rollers located in second and third position to be de-aligned, but these intermediate rollers are biased to the alignment position by return springs. So long as alignment of the four rollers is maintained, the force exerted by the bolt is transmitted in full from roller to roller up to the case. When the push-button is actuated, the two intermediate rollers are made to roll to their de-aligned position against the biasing force of the return springs. As soon as the alignment of the rollers has been broken, the bolt is released. The ability to keep the intermediate rollers in the alignment of the bolt depends on the calibration of the return springs. As soon as the intermediate rollers start to be de-aligned, a large part of the force exerted by the bolt is in fact transmitted to the return springs. As soon as the device is subjected to impacts or vibrations tending to de-align the rollers, the return springs are subjected to strong stresses due to the forces exerted by the bolt. If the sensitivity of the device to impacts is to be decreased, the stiffness of the return springs has to be increased, so that the force to be applied on the rod to de-align the device increases. The travel of the bolt is moreover limited.

SUMMARY OF THE INVENTION

The object of the invention is therefore to remedy the shortcomings of the state of the prior art so as to propose a ball actuator of great efficiency, requiring a very low operating energy to release a high mechanical energy.

Another object is to reduce the dimensions of the actuator for a given stored mechanical energy. Another object is to increase the travel of the movable means delivering the stored kinetic energy. Another object is to make the actuator mechanism relatively insensitive to dimensional variations due to manufacturing tolerances or wear. Another object is to make the actuator relatively insensitive to mechanical impacts and vibrations. Another object is to increase the speed of the actuator. In a more general manner, another object is finally to reduce the manufacturing cost of the actuator.

According to the invention, these objectives are achieved by means of an actuator comprising:

- a case defining a geometric axis of translation;
- a control rod movable in translation with respect to the case in a direction parallel to the geometric axis of translation between a latched control position and an unlatched control position, and comprising a rolling surface,
- a striker movable in translation with respect to the case in a direction parallel to the geometric axis of translation between a loaded position and an unloaded position, and comprising a bearing collar,
- a drive means of the striker operating in conjunction with the striker in such a way that when the striker is in its loaded position, the drive means of the striker bias the striker to return to the unloaded position,
- a set of n detent balls, n being an integer greater than or equal to three, each detent ball being movable between a latched position and a cleared position, each detent ball in the latched position being pressing against said bearing collar of the striker, each detent ball having a center, a set of n control balls, each control ball having a center, the actuator being such that when the striker is in the loaded position and the rod is in the latched control position, the centers of the detent balls are located in a first geometric plane perpendicular to the geometric axis of translation, the centers of the control balls are located in a second geometric plane perpendicular to the geometric axis of translation, each control ball is bearing against the rolling surface of the rod and against two corresponding detent balls belonging to the set of detent balls and the center of each control ball is situated between the rod and a third geometric plane parallel to the geometric axis of translation and passing through the center of each of said two corresponding detent balls.

Placing a control ball between two detent balls enables a distribution of the forces to be achieved such that the forces applied by the control balls to the rod have a component perpendicular to the axis of translation of the rod which is lower than the component in a plane perpendicular to the axis of translation of the rod of the forces applied by the striker to the detent balls. In other words, part of the forces applied by the striker are not transmitted to the rod. The operating energy required for movement of the rod between its latched control position and its unlatched control position is therefore low. This enables the power, consumption and dimensions of the rod drive means to be reduced.

Furthermore, the movable mass formed by the balls is relatively small and movement thereof is of very small amplitude, on the one hand unlatching of the striker consecutive to movement of the rod is very fast, which ensures a particularly good response time, and on the other hand the potential energy stored in the spring is almost fully transmitted to the striker, which ensures a very good efficiency of the mechanism.

Moreover, movement of the rod is perpendicular to the first and second planes, so that the balls work by rolling on the rod, and not by sliding, resulting in minimal wear.

Preferably, the drive means of the striker comprise an energy storage spring operating in conjunction with the case and with the striker, in such a way that when the striker is in its loaded position, the energy storage spring is in a loaded state and biases the striker to return to the unloaded position. The energy required to drive the rod is very small for a high potential energy stored in the energy storage spring. The actuator achieved constitutes a functional unit not requiring large adjustments when installation thereof is performed.

Preferably, the energy storage spring is a helical spring coaxial with the geometric axis. The rod is arranged along the geometric axis of translation, the bearing collar of the striker forms a surface of revolution around the geometric axis of translation, the centers of the detent balls form n peaks of a polygon with n sides centered on the geometric axis of translation and the centers of the control balls form n peaks of a polygon with n sides centered on the geometric axis of translation. The control balls are thus automatically centered by the combined action of the detent balls, which makes the device relatively insensitive to the effects of dimensional dispersions and wear.

Preferably, the device comprises in addition a return means for returning the rod to the latched control position and a drive means for driving the rod to the unlatched control position. Due to the reduction of the latching forces obtained by means of the relative arrangement of the control balls and of the detent balls, the force that has to be exerted by the return means of the rod is relatively low, so that the drive means of the rod only has to supply a small amount of energy to counteract the action of the return means of the rod and to drive the rod to the unlatched position.

According to a preferred embodiment, a movable assembly made of ferromagnetic material slides in translation securedly with the rod. The drive means of the rod comprise an electromagnetic excitation winding to drive the movable assembly.

Advantageously, the movable assembly is housed in a cavity of the case. The winding is supported by the case. The chains of dimensions are then reduced. The reliability of the device is thereby improved. Furthermore, the assembly obtained is particularly compact.

Advantageously the movable assembly is formed by a part of the rod. The number of parts is therefore reduced.

According to one embodiment, the return means of the rod comprise a permanent magnet attracting the movable assembly. The permanent magnet alone is sufficient to keep the rod in the latched position and possibly to perform resetting of the rod either completely or in part. This enables the electrical consumption of the control actuator to be reduced considerably. Alternatively or cumulatively, the return means of the rod comprise a return spring.

According to one embodiment, the rod comprises an axial stop whereon the control balls bear when the striker is in the loaded position and the rod is in the latched control position, the first and second geometric planes being distinct, the second geometric plane being situated between the first geometric plane and the axial stop. With such an arrangement, the mechanism is polarized mechanically to the unlatched position since the resultant of the forces applied by the control balls on the rod comprises an axial component. Take-up of the play between the balls is even more efficient.

Preferably the rod, when moving from the latched control position to the unlatched control position, moves in an operating direction, the second geometric plane being offset from the first geometric plane in said operating direction. The resultant of the forces exerted by the control balls on the rod then has an axial component tending to drive the rod to its unlatched control position. The tripping movement is then very fast, and the power required to move the rod to the unlatched position is very low.

Alternatively, it is possible for the first and second planes to be one and the same. In this case, the forces transmitted to the rod are purely perpendicular to the geometric axis of translation.

Advantageously a movable auxiliary push-button drives the rod from the latched control position to the unlatched control position passing from a first position to a second position.

The push-button enables the mechanism to be actuated manually to check the operation of the actuator. It also enables tripping to be performed by a mechanism external to the device and designed to operate in parallel with the electromagnetic control actuator.

Advantageously, the control balls, the detent balls and at least a part of the rod are housed in a cavity confined by walls of the case and by the striker, said walls forming a guiding surface operating in conjunction with the striker so as to achieve dust-tightness when the striker moves between the loaded position and the unloaded position. Reliability of the mechanism is thus achieved with a great saving of means.

BRIEF DESCRIPTION OF THE DRAWINGS

Other advantages and features will become more clearly apparent from the following description of particular embodiments of the invention, given as non-restrictive examples only and represented in the accompanying drawings in which.

DETAILED DESCRIPTION OF DIFFERENT EMBODIMENTS

Figure 1:
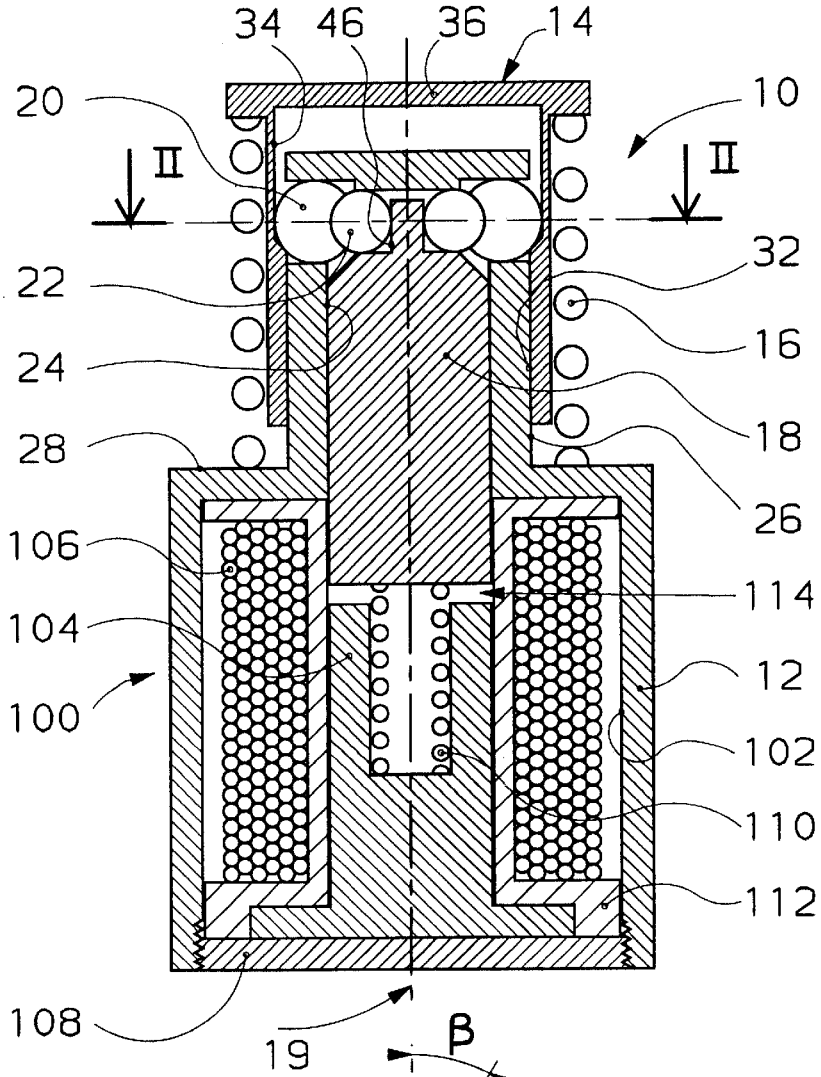
FIG. 1 represents an axial cross-section of a device according to a first embodiment of the invention, in a loaded position.

With reference to FIGS. 1 to 6, a ball actuator 10 according to a first embodiment of the invention comprises a case 12 supporting a striker 14 with an energy storage spring 16, a control rod 18 movable in translation parallel to a geometric axis 19, detent balls 20 and control balls 22.

Figure 2:
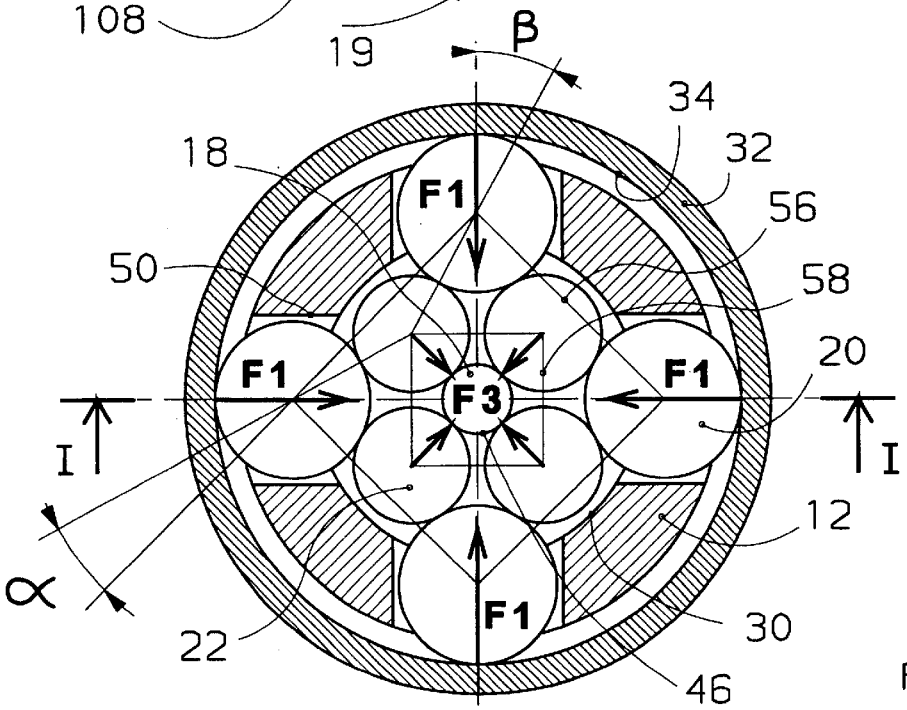
FIG. 2 represents an enlarged radial cross-section along a plane II—II of FIG. 1 of the device according to the first embodiment of the invention, in the loaded position.
Figure 3:
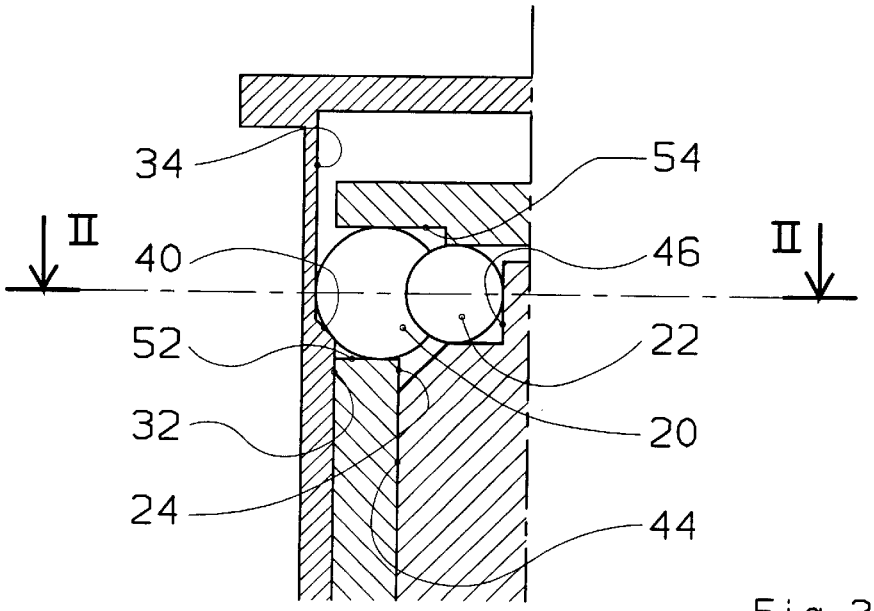
FIG. 3 represents an enlarged detail of FIG. 1.

The case 12, of general cylindrical shape, forms an axial internal guide bore 24 for the control rod 18, a cylindrical external guiding surface 26 for the striker 14, a supporting shoulder 28 for an end of the energy storage spring 16 and a cage 30, visible in FIG. 2, to receive the detent balls 20 and the control balls 22. The striker 14 comprises a cylindrical tubular part 32 sliding on the external guiding surface 26 of the case, and is extended by a recess 34 of slightly greater internal diameter closed by a cover 36 acting as bearing support for a second end of the energy storage spring 16. The striker 14 and the external guiding surface 26 of the case are machined in such a way as to achieve dust-tightness. A chamfer 40, visible in particular in FIG. 3, joins the tubular guiding part 32 to the recess 34. The rod 18 comprises a guiding surface 44 sliding on the walls 24 of the axial internal guide bore of the case, and a cylindrical rolling surface 46. The energy storage spring 16 is a compression spring which accumulates potential energy when compressed and releases the kinetic energy when relaxed. As shown by FIGS. 2 and 3, the cage 30 comprises radial guiding surfaces 50 performing radial guiding of the detent balls 20 and axial guiding surfaces 52, 54 performing axial holding of the detent balls 20.

An electromagnetic relay 100 with an electromagnet is associated to the actuator to drive the control rod 18. The relay is housed in a recess 102 of the case and comprises a shunt 104 designed to enhance the magnetic field, a magnetizing coil 106, a stopper 108 enabling the magnetic flux to be reclosed and a return spring 110, the assembly being positioned and guided by means of an insulating frame 112. The rod 18 is made of ferromagnetic material and thus constitutes a plunger core biased by the return spring 110 in the enlargement direction of the air-gap 114 between the rod 18 and the shunt 104.

In the loaded position of FIGS. 1 to 3, the centers of the detent balls 20 form the peaks of a first polygon 56, in this instance a square, situated in a geometric plane perpendicular to the axis of translation 19 of the rod, in this instance the cross-sectional plane II—II of FIG. 2. The control balls 22 are in contact with the rolling surface of the rod and are located between the detent balls 20. The centers of the control balls 22 form the peaks of a second polygon 58, in this instance a square, also situated in the geometric cross-sectional plane II—II of FIG. 2, inside the first polygon 56, and offset from the latter by an eighth of a turn so that each detent ball 20 is pressing on two control balls 22 and that each control ball 22 acts as support for two detent balls 20. The control balls are pressing against the axial stop 54. The detent balls 20 are pressing against the chamfer 40. The energy storage spring 16 is compressed. The striker 14 is therefore blocked in position by the detent balls 20 which are themselves blocked by the control balls 22 held in position by the rod due to the thrust of the return spring which tends to move the rod away from the shunt. The rod 18 is in a position called the latched control position.

Figure 4:
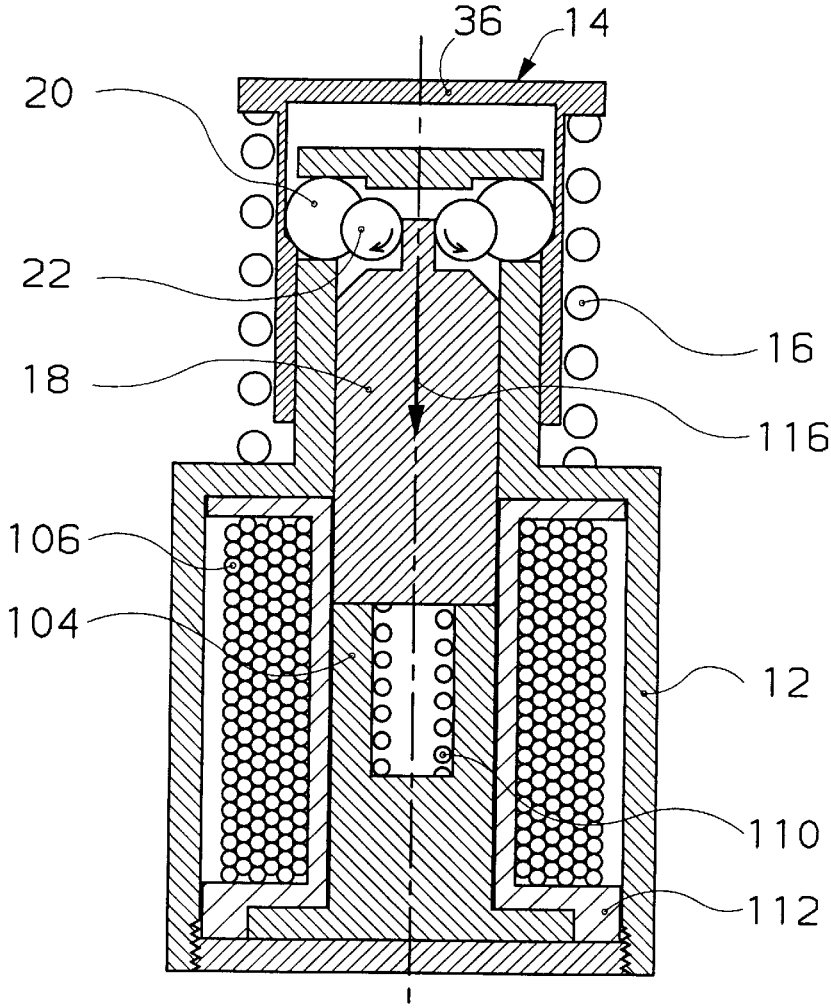
FIG. 4 represents an axial cross-section of the device according to the first embodiment of the invention, in a transient intermediate tripping position.

To operate the device, power is supplied to the coil 106. The plunger core formed by the rod 18 is attracted in the direction of the arrow 116 in FIG. 4 and comes and presses on the shunt 104 against the return force of the spring 110. The control balls 22 roll on the rolling surface 46 as indicated in FIG. 4 and leave the geometric cross-sectional plane of FIG. 2. As soon as the alignment has been broken, the detent balls, due to the thrust exerted by the chamfer 40, eject the control balls 22 which escape in an axial direction according to the arrows represented in FIG. 5. The detent balls 20 move away radially towards the rod 18 in the freed space as shown by FIG. 6 and release the striker 14. The striker 14 is driven upwards by the energy storage spring 16 until it reaches an unloaded position represented in FIG. 5. The rod 18 is then in a position called the unlatched control position.

Figure 5:
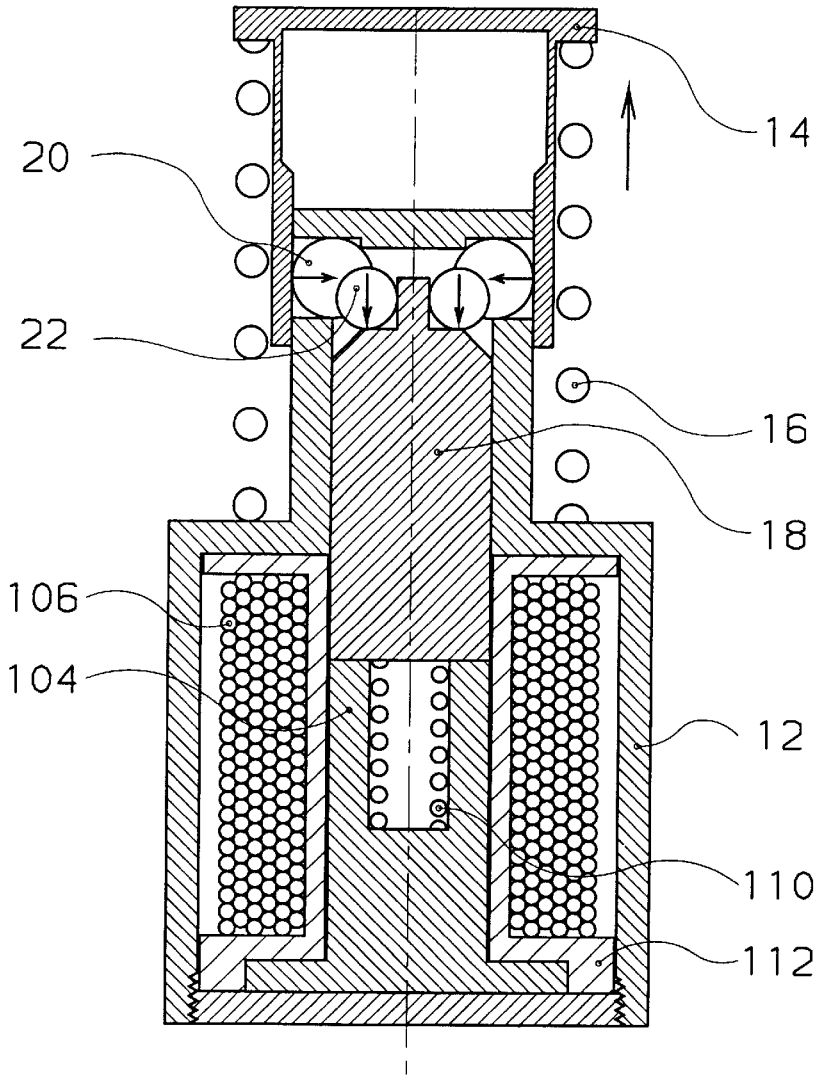
FIG. 5 represents an axial cross-section of the device according to the first embodiment of the invention, in an unloaded position.
Figure 6:
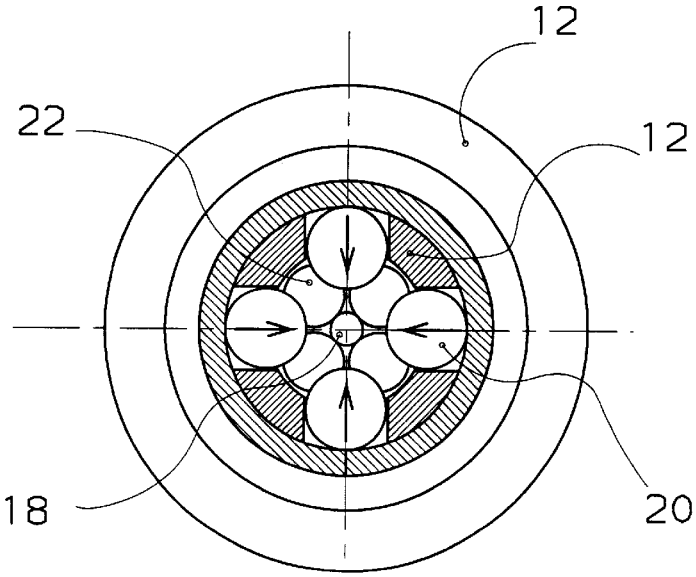
FIG. 6 represents a radial cross-section of the device according to the first embodiment of the invention, in an unloaded position.
Figure 8:
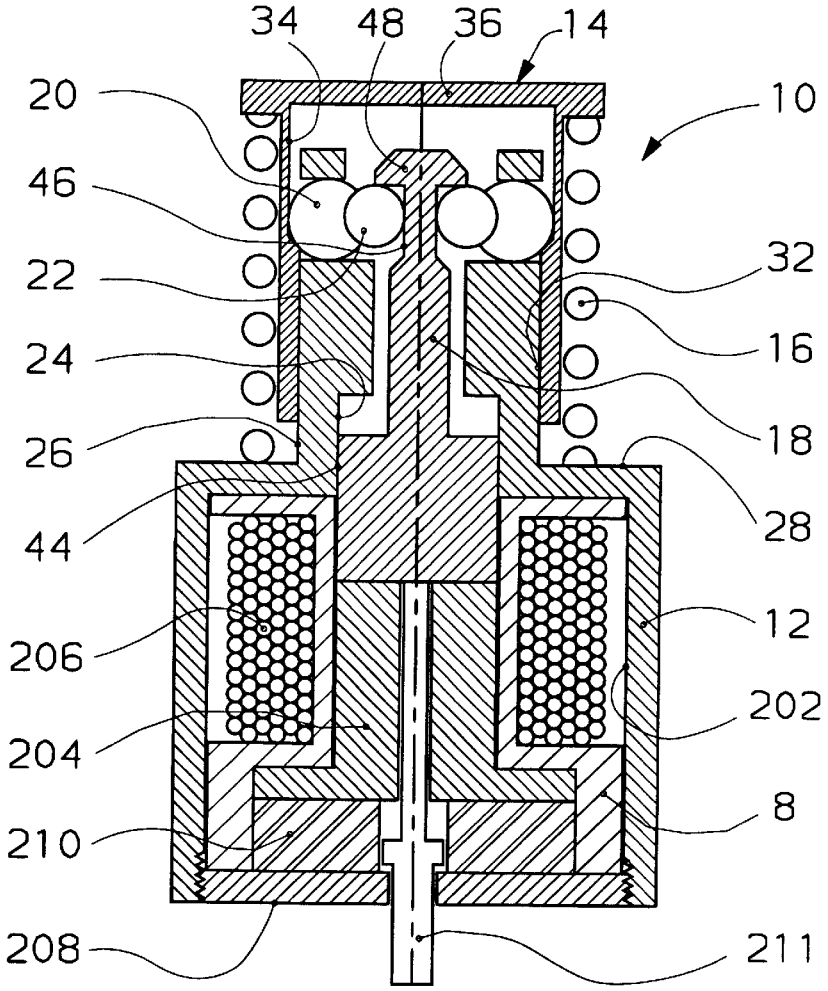
FIG. 8 represents an axial cross-section of a device according to a second embodiment of the invention, in the loaded position.

To reset the actuator 10, the striker 14 in a first step has to be moved by any means from the position of FIG. 5 to that of FIG. 1, which again gives the detent balls 20 space. The rod, due to the repelling action of the return spring 110, re-establishes the air-gap 114 with the shunt 104. The detent balls 20 and control balls 22 then revert to their position represented in FIG. 1. The interposed detent balls 20 block the striker 14 in the loaded position.

To model the system simply, the following have been represented in FIG. 2:

an angle $\alpha$ between an axis passing through the centers of two adjacent detent balls on the one hand, and an axis passing through the center of one of the two detent balls and the center of an adjacent control ball on the other hand;

an angle $\beta$ between the axis passing through the centers of two adjacent detent balls on the one hand, and an axis passing through the center of a detent ball and cutting the axis of translation of the rod on the other hand.

In this simplified model, the force exerted by the striker on each detent ball is considered to have an axial component $F_0$ parallel to the geometric axis and a radial component $F_1$. As the reaction forces between two balls are essentially perpendicular to the contact surface, the detent balls 20 can only transmit purely radial forces to the control balls 22. Consequently, the axial guiding surfaces 54 of the balls take up the whole of the axial component. Each of the detent balls 20 exerts a purely radial force $F_2$ on each of the adjacent control balls 22, the modulus of which force is a function of the angle $\beta$ according $$F_2 = \frac{F_1}{2 \cos \beta}$$

Taking account of the symmetries of the system, assuming that the forces exerted by the striker on each of the detent balls have a radial component whose modulus is equal to $F_1$ and observing that each control ball is subjected to the forces exerted by two detent balls, we can deduce that each control ball exerts a radial force on the rolling surface of the rod, the modulus $F_3$ of which force is a function of the angle $\alpha$ according to the formula:

$$F_3=2F_2\sin \alpha$$

The angles α and β are linked by the equations:

$$\begin{cases} 2(\alpha+\beta)+\dfrac{2\pi}{n}=\pi \\ 0<\beta<\dfrac{\pi}{2} \\ 0<\alpha<\dfrac{\pi}{2} \\ n\geq 3 \end{cases}$$

i.e.:

$$\begin{cases} \alpha+\beta=\dfrac{n-2}{2n}\pi \\ 0<\beta<\dfrac{n-2}{2n}\pi<\dfrac{\pi}{2} \end{cases}$$

where n is an integer greater than 2, representing the number of detent balls, which number is moreover equal to the number of control balls.

A relation is thus obtained between the ratio $F_3/F_1$ and the angle β for a given number n, which is expressed in the following manner:

$$\begin{cases} \dfrac{F_3}{F_1}=\dfrac{\sin\alpha}{\cos\beta}=\dfrac{\sin\left(\dfrac{n-2}{2n}\pi-\beta\right)}{\cos\beta}=\sin\left(\dfrac{n-2}{2n}\pi\right)-tg\,\beta\cos\left(\dfrac{n-2}{2n}\pi\right) \\ 0<\dfrac{F_3}{F_1}<\sin\left(\dfrac{n-2}{2n}\pi\right)<1 \end{cases}$$

It can therefore be seen that the ratio $F_3/F_1$ is always less than 1. In the particular case considered in the first embodiment of the invention, where n=4, we obtain:

$$\begin{cases} \dfrac{F_3}{F_1}=\dfrac{\sqrt{2}}{2}(1-tg\,\beta) \\ 0<\dfrac{F_3}{F_1}<\dfrac{\sqrt{2}}{2} \end{cases}$$

The modulus $F_3$ of the force exerted by the control balls on the rod in the loaded position conditions the energy required for operation of the rod. By making the diameter of the rod and the diameter of the balls vary, we can make the angle β in the gap, and therefore the value of $F_3$ for a given latching force $F_1$, vary. A wide range of actuators can therefore be obtained using more or less powerful springs without having to vary the operating energy.

Figure 7:
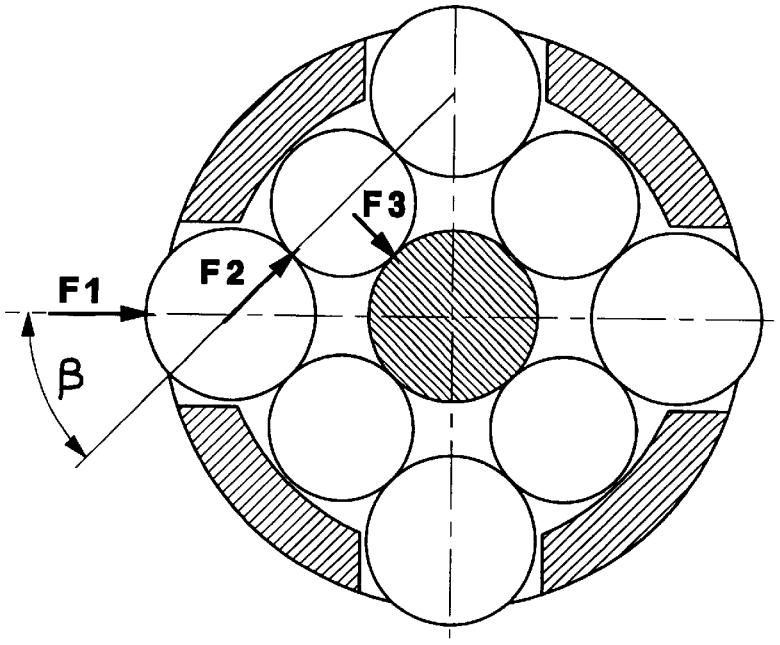
FIG. 7 represents a radial cross-section of a device illustrating a theoretical limit case.

The theoretical limit of the model is obtained with the purely theoretical diagram of FIG. 7 where the angle α is zero and where the force $F_3$ transmitted to the rod 18 is nil.

The above simplified model does not take account of the dimensional differences due to the tolerances and wear of the mechanism. It should however be underlined that the control balls are each urged by two detent balls and by the rod, so that they distribute the forces applied by the detent balls. Furthermore, they are automatically centered in the radial plane of operation.

The actuator according to the second embodiment of the invention, represented in FIGS. 8 to 11, is of similar constitution to that of the first embodiment so that the same reference signs have been taken to designate identical or similar elements. The actuator according to the second embodiment differs from the previous one essentially by the fact that in the loaded position, the centers of the detent balls 20 are in a first geometric plane 60 perpendicular to the axis of translation 19 of the rod, and the centers of the control balls are in a second plane 62, parallel to the first plane 60, and offset from the latter. This arrangement has the effect of adding an axial component to the force transmitted by the detent balls to the control balls in the loaded position. In the loaded position, the control balls 22 press on an axial stop 64 formed by a head 48 of the rod and transmit the axial forces thereto. An axial holding force therefore has to be applied to the rod 18 so as to keep the actuator in the loaded position. When the holding force is interrupted, the control balls 22 repel the rod 18 and move upwards releasing the detent balls 20.

An electromagnetic relay 200 is associated to the actuator to drive the rod 18. The relay is housed in a recess 102 of the case and comprises a shunt 204 designed to enhance the magnetic field, a demagnetizing coil 206, a stopper 208 enabling the magnetic flux to be reclosed, a permanent magnet 210 arranged opposite the end of the rod 18 and a mechanical push-button 211, the assembly being guided and held in position by a frame 212. The rod 18 is made of ferromagnetic material and constitutes a plunger core of the relay 200.

Figure 10:
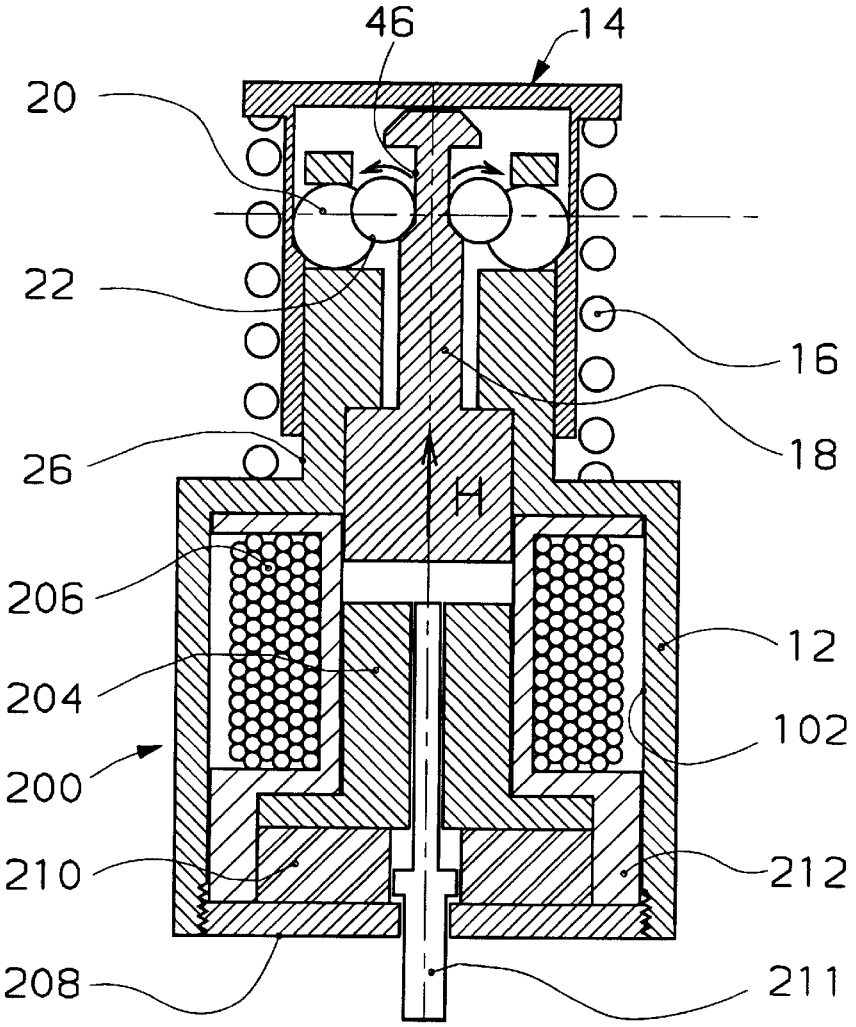
FIG. 10 represents an axial cross-section of the device according to the second embodiment of the invention, in a transient intermediate tripping position.
Figure 9:
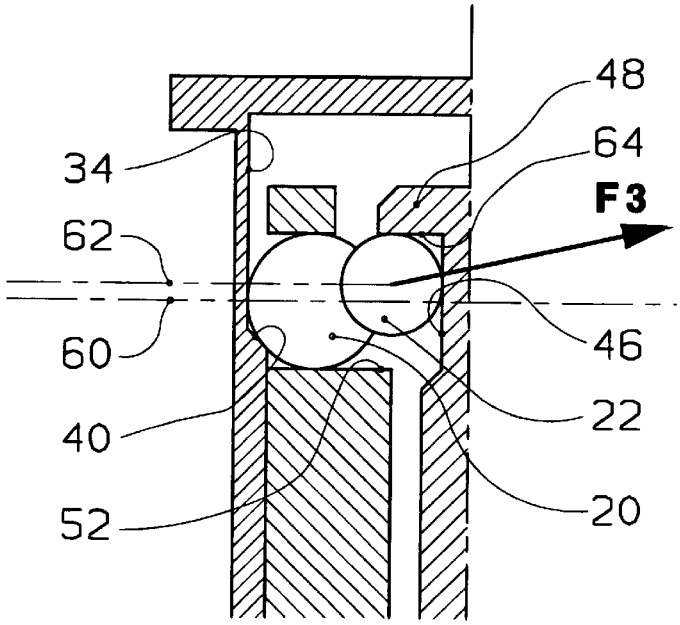
FIG. 9 represents an enlarged detail of FIG. 8.
Figure 11:
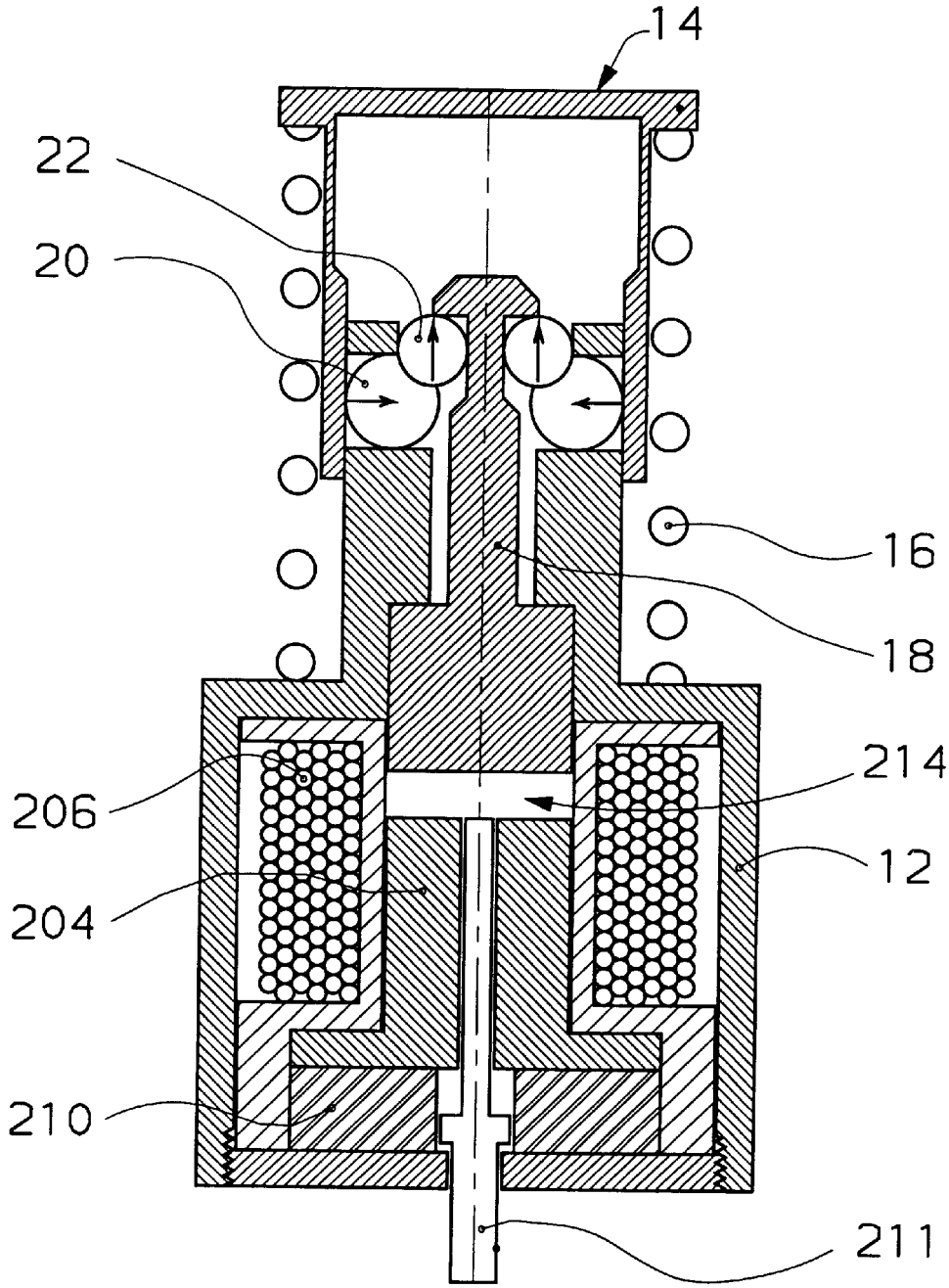
FIG. 11 represents an axial cross-section of the device according to the second embodiment of the invention, in an unloaded position.

The actuator according to the second mode embodiment of the invention operates in the following manner. In the loaded position, in FIG. 8, the permanent magnet 210 urges the rod to its latched control position, with a force greater than the axial resultant of the forces exerted by the control balls 22 on the rod 18, so that the permanent magnet 210 holds the rod 18 in the latched control position. When power is supplied to the coil 206, the latter produces a magnetic flux annulling that of the permanent magnet 210, so that the rod 18, urged by the control balls 22, comes unstuck from the shunt 204 and creates an air-gap 214. The control balls roll on the rolling surface 46 as shown by FIG. 10, and are then ejected as shown by FIG. 11. Resetting of the device is achieved by moving the striker by any means to the loaded position of FIG. 8. As soon as this position has been reached, the permanent magnet 210 attracts the rod 18 which comes into abutment against the shunt 204. The push-button 211 is an optional element enabling mechanical tripping of the device to be performed. In the loaded position of FIG. 8, it rests via one end against the end of the rod 18. If the push-button 211 is depressed, it drives the rod 18.

In the latched control position, the control balls 22 are urged radially and axially on the one hand by the two adjacent detent balls 20 and on the other hand by the rod 18, at the level of the head 48 and of the rolling surface 46. Centering of the control balls 22 and taking-up of the dimensional differences are performed naturally.

Resetting of the actuator can be achieved by an interaction between the rod and the striker: in a first step, the striker is moved to the loaded position and repels the head of the rod, freeing the space necessary for housing the balls, then in a second step, the striker continues its travel beyond the loaded position to press the rod against the permanent magnet. This enables the power of the permanent magnet to be limited.

Various modifications are naturally possible.

The invention is applicable with any number n of detent balls, n being an integer greater than or equal to three. In practice, an embodiment with three balls or five balls, or more, can perfectly well be envisaged. For any number n of balls (n being greater than three), the centers of the detent balls form a polygon with n sides and the centers of the control balls also form a polygon with n sides, inscribed inside the previous one and offset from the latter by $\pi/n$. More generally, the center of each control ball is situated between the rod on the one hand and a plane parallel to the axis of translation 19 and passing through the centers of the two detent balls with which it is in contact on the other hand, which means in a certain manner that each detent ball is located between the two detent balls with which it is in contact and the rod.

The energy storage spring can be replaced by any other type of drive means performing driving of the striker from the loaded position to the unloaded position, and also constant biasing to the unloaded position, so long as the striker is in the loaded position. A drive means formed by a mass acting by gravity on the end of the striker could notably be envisaged, in the case where the latter is placed downwards, in the opposite direction to that illustrated by the figures.

The electromagnetic relay can be of any type: with or without permanent magnet, polarized or not, etc. The actuator can be associated to any other control device than an electromagnet. The rod is not necessarily made of ferromagnetic material, it can be securedly attached to a magnetic core.

The purely mechanical parts and the electromagnetic drive means of the first and second embodiments can be inverted. Thus, a relay with a permanent magnet can be fitted to an actuator having, in the latched control position, coplanar centers of the detent balls and control balls. In the reverse manner, a relay with a return spring can be fitted to an actuator having two distinct planes 60, 62.

The electromagnetic relay can be housed in a case independent from the actuator case. The shunt and stopper may be in a single part.

The rolling surface can have a non-circular radial cross-section, for example a polygonal cross-section with a flat facet per control ball. The radial cross-section of the rolling surface may not be constant. In particular, the rolling surface may be tapered so that the force applied by the control balls to the rod has an axial component. The rolling surface may be a revolution surface around the axis of translation of the rod having any curvature, thus enabling modulation of the axial component of the resultant of the forces applied by the control balls to the rod during movement of the rod.

The direction of movement of the striker when relaxation of the energy storage spring takes place can be opposite to the direction of movement of the rod from its latched control position to its unlatched control position. The rod may protrude out through the striker.

According to a variant, not represented, of the second embodiment, it is also possible to provide a device wherein the plane containing the centers of the control balls is situated below the plane containing the centers of the detent balls, so that the control balls exert on an intermediate stop of the rod a force having an axial component tending to repel the rod against an end of travel stop. Such an actuator has a stable loaded position. To release the energy storage spring, the rod has to be driven upwards so that the control balls repel the detent balls radially towards the outside, which detent balls, in contact with a ramp of the shoulder, repel the striker axially against the force exerted by the energy storage spring. As soon as the control balls pass the dead point and are situated above the detent balls, the control balls are ejected as in the previous embodiments and the striker is released. This embodiment naturally procures the advantage of a greater stability in the loaded position but it requires a greater operating energy.

The actuator is not necessarily associated to an electromagnetic drive means. Applications can be envisaged wherein the rod is operated by hand or any suitable means. It can in particular be envisaged that the rod be operated by its own gravity, by placing the actuator upside down with respect to the embodiments of the figures.

What is claimed is:

1. An actuator (10) comprising:

a case (12) defining a geometric axis of translation (19);

a control rod (18) movable in translation with respect to the case (12) in a direction parallel to the geometric axis of translation (19) between a latched control position and an unlatched control position, and comprising a rolling surface (46), a striker (14) movable in translation with respect to the case in a direction parallel to the geometric axis of translation (19) between a loaded position and an unloaded position, and comprising a bearing collar (40), a drive means (16) of the striker (14) operating in conjunction with the striker (14) in such a way that when the striker (14) is in its loaded position, the drive means (16) of the striker bias the striker to return to the unloaded position, a set of n detent balls (20), n being an integer greater than or equal to three, each detent ball (20) being movable between a latched position and a cleared position, each detent ball (20) in the latched position being pressing against said bearing collar (40) of the striker, each detent ball having a center, a set of n control balls (22), each control ball having a center, the actuator being such that when the striker (14) is in the loaded position and the rod (18) is in the latched control position, the centers of the detent balls (20) are located in a first geometric plane (II—II, 60) perpendicular to the geometric axis of translation (19), the centers of the control balls (22) are located in a second geometric plane (II—II, 62) perpendicular to the geometric axis of translation (19), each control ball (22) is bearing against the rolling surface (40) of the rod and against two corresponding detent balls belonging to the set of detent balls (20) and the center of each control ball (20) is situated between the rod (18) and a third geometric plane parallel to the geometric axis of translation and passing through the center of each of said two corresponding detent balls.

2. The actuator according to claim 1, wherein the drive means (16) of the striker (14) comprise an energy storage spring (16) operating in conjunction with the case (12) and with the striker (14) in such a way that when the striker (14) is in its loaded position, the energy storage spring (16) is in a loaded state and biases the striker (14) to return to the unloaded position.

3. The actuator according to claim 2, wherein the energy storage spring (16) is a helical spring coaxial with the geometric axis (19).

4. The actuator according to claim 1, characterized in that the rod (18) is arranged along the geometric axis of translation (19), the bearing collar (40) of the striker forms a surface of revolution around the geometric axis of translation (19), the centers of the detent balls form n peaks of a polygon (56) with n sides centered on the geometric axis of translation (19) and the centers of the control balls form n peaks of a polygon (58) with n sides centered on the geometric axis of translation (19).

5. The actuator according to claim 1, characterized in that it comprises in addition:

a return means for returning the rod (110, 210) to the latched control position;

a drive means for driving the rod (106, 206) to the unlatched control position.

6. The actuator according to claim 5, comprising a movable assembly made of ferromagnetic material sliding in translation securedly with the rod and wherein the drive means of the rod (106, 206) comprise an electromagnetic excitation winding (106, 206) to drive the movable assembly.

7. The actuator according to claim 6, wherein the movable assembly is housed in a cavity (102) of the case.

8. The actuator according to claim 6, characterized in that the movable assembly is formed by a part of the rod (18).

9. The actuator according to claim 6, characterized in that the winding (106, 206) is supported by the case.

10. The actuator according to claim 6, characterized in that the return means of the rod comprise a permanent magnet (210) attracting the movable assembly.

11. The actuator according to claim 6, characterized in that the return means of the rod comprise a return spring (110).

12. The actuator according to claim 1, characterized in that the rod (18) comprises an axial stop (64) whereon the control balls (22) bear when the striker (14) is in the loaded position and the rod is in the latched control position, the first (60) and second (62) geometric planes being distinct, the second geometric plane (62) being situated between the first geometric plane (60) and the axial stop (64).

13. The actuator according to claim 12, such that the rod (18), when moving from the latched control position to the unlatched control position, moves in an operating direction, the second geometric plane (62) being offset from the first geometric plane (60) in said operating direction.

14. The actuator according to claim 1, characterized in that the first and second geometric planes (II—II) are one and the same.

15. The actuator according to claim 1, characterized in that it comprises in addition a movable auxiliary push-button (211) driving the rod (18) from the latched control position to the unlatched control position passing from a first position to a second position.

16. The actuator according to claim 1, characterized in that the control balls (22) , the detent balls (20) and at least a part of the rod (18) are housed in a cavity confined by walls of the case (12) and by the striker (14), said walls forming a guiding surface (26) operating in conjunction with the striker so as to achieve dust-tightness when the striker moves between the loaded position and the unloaded position.

* * * * *